United States Patent [19]

Martin

[11] Patent Number: 4,518,684

[45] Date of Patent: May 21, 1985

[54] RAPID X-RAY DEVELOPING SYSTEM

[76] Inventor: Howard Martin, 909 Pershing Dr., Silver Spring, Md. 20910

[21] Appl. No.: 611,481

[22] Filed: May 17, 1984

[51] Int. Cl.[3] ..... G03C 5/24; G03C 1/48

[52] U.S. Cl. ..... 430/403; 430/347; 430/496; 430/497; 430/966; 383/52; 206/63.3; 206/63.5; 206/455; 206/633; 354/328

[58] Field of Search ..... 383/52; 206/63.3, 63.5, 206/633, 455; 378/168, 169, 183; 430/966, 496, 497, 403, 256, 347, 644; 354/328, 324

[56] References Cited

U.S. PATENT DOCUMENTS

| | | | |
|---|---|---|---|
| 1,536,341 | 5/1925 | Hodgson | 206/455 |
| 3,069,266 | 12/1962 | Land | 430/497 |
| 3,197,119 | 7/1965 | Hartig et al. | 383/52 |
| 3,430,042 | 2/1969 | Neri | 378/169 |
| 3,575,099 | 4/1971 | Levenson et al. | 354/328 |
| 3,950,172 | 4/1976 | Craig et al. | 378/169 |
| 4,236,806 | 12/1980 | Hoadley | 378/183 |

*Primary Examiner*—Mary F. Downey
*Attorney, Agent, or Firm*—Walter G. Fincher

[57] ABSTRACT

The invention is an improved system for the rapid development of X-rays. The system is particularly useful for the development of dental-type X-rays. The system consists of an enclosed sealed pouch-like holder for the unexposed X-ray film, a special pocket built into the pouch-like holder for guiding an injection needle during operation of the device, a sealant within the specific pocket through which the injection needle is inserted, and a syringe-type injector with injection needle and a supply of monobath solution (a combined developer and fixer solution).

10 Claims, 3 Drawing Figures

3
58
50
22
32
30
34
D
56
56
F
3

10
12
2
32
34
46
30
40
22
44
48
24
42
36
36
F
38
2
14
20
16
18
30
34
52
40
44
46
48
22
54
24
26
50
F
42
36
36
D

RAPID X-RAY DEVELOPING SYSTEM

BACKGROUND AND SUMMARY OF THE INVENTION

The invention relates to X-ray type systems and in particular to that portion of such systems that pertain to the development and fixing of exposed X-ray films. Specifically, the invention relates to a rapid means of developing and fixing exposed X-ray film, particularly useful for the development and fixing of dental-type exposed X-ray film. Such X-rays may also be referred to as radiographs.

In the prior art of processing exposed X-ray film it was necessary to use a dark room and a series of baths and pieces of equipment for developing and fixing the exposed film. Later some attempts at rapid development were made using a monobath solution, a combined developer and fixing solution. Still later in the prior art the film was enclosed in a container, exposed, and then developed and fixed by injecting a monobath solution into the container.

Problems exist in the above latter mentioned prior art method and device in that the container leaks, particularly where the injection was made for the monobath solution and where the injecting device further punctured or damaged the container. The leakage results in irregular and poor quality developed negatives of the exposed film. The leaking material is also objectionable because of its staining effect on the hands, clothes, and surrounding objects. The present invention overcomes these problems.

The present invention is particularly useful when dental-type X-ray film is to be developed. The pouch-like enclosure of the exposed X-ray film can be injected with the monobath solution and massaged for approximately 15 seconds to completely treat the film by assuring that the monobath solution is massaged against the film. In effect, the present invention becomes a "chair-side system" for processing the film beside the dental patient chair as soon as it is exposed.

The specific structure of the pouch-like enclosure of the present invention assures that the insertion of the injection needle does not puncture or damage the pouch-like enclosure so that other openings are caused that result in leakage of the solution. A special pocket assures a properly aimed and directed needle injection, and a thickened area in the pouch-like enclosure beyond the point of injection assures that further puncture or damage to the pouch-like enclosure is prevented.

A sealant that fills the special pocket assures the effective sealing of the point where the injection needle entered the pouch-like enclosure wall, thus preventing leakage of the monobath solution at that point and any consequent staining as aforementioned.

The present invention, described hereinbefore as being particularly useful for developing and fixing dental-type exposed X-ray film, may also be used for developing and fixing other exposed X-ray film, regardless of size or configuration.

The present invention consists of an unexposed X-ray film enclosed in a pouch-like enclosure, described hereinafter. Within the enclosed pouch-like enclosure the unexposed X-ray film may have a gauze-like or paper-like insert on each side of and interfacing with the unexposed X-ray film. The gauze-like or paper-like insert on each side of the unexposed X-ray film is useful in a later phase of the use of the present invention to assure that injected monobath solution, described hereinafter, completely wets and washes the surfaces of the X-ray film after exposure for a proper development and fixing.

It is to be understood, however, that the assembly of the present invention without the use of the gauze-like or paperlike inserts is also within the scope and intent of this invention.

The pouch-like enclosure mentioned hereinbefore for the unexposed X-ray film is completely sealed around the X-ray film as described hereinafter. The pouch-like enclosure consists of a front wall member and a back wall member. The front wall member and the back wall member are sealed around the unexposed film in a distinctive seam pattern as shown in the drawings and as will be described in detail in the Description of the Preferred Embodiments.

The distinctive seam pattern provides for the formation of a pocket where an injection needle may be inserted as described hereinafter. The pocket serves to guide the injection needle for a proper in-line insertion, and also as pocket holding means for a self-sealing sealer, through which the needle is inserted. The sealer seals the opening when the injection needle is withdrawn. The proper sealing can be assured by gently and firmly squeezing the pocket area on the outside of the front and back wall members as the injection needle is withdrawn.

The distinctive seam pattern also provides for a thickened seam portion beyond the normal insertion point of the insertion needle to provide a reinforced seal to prevent a puncture of the pouch-like enclosure in case the insertion needle is inserted an excessive distance.

The front wall member is made shorter in length at the top end than the back wall member so as to provide an easy means of separating and gripping the two wall members when the pouch-like enclosure is to be pulled apart to remove the developed and fixed negative after processing the exposed film. The shortened front wall member also provides an indicating means as to the position of the unexposed X-ray film inside of the sealed pouch-like enclosure. The vinyl backing of the film package is vinyl lead.

After the film has been exposed, such as in and for the case of a dental-type X-ray film, it is ready for the rapid X-ray developing procedure of the rapid X-ray developing system of the present invention.

For the rapid developing procedure a syringe-type device fitted to a supply container for and of a monobath solution (as aforementioned), is also fitted with an injection needle. The injection needle is inserted through and within, and guided by, the pocket formed by the distinctive seam pattern of the pouch-like enclosure of the X-ray film. The injection needle passes through the aforementioned self-sealing sealant within the pocket.

As the injection needle punctures and passes through the end seam of the pocket, which may be referred to as the bottom seam of the pocket, the needle opening of the injection needle is then within the interior of the pouch-like enclosure where the exposed X-ray film is located. Operation of the syringe type device, a pumping action, pumps a portion of the monobath solution in and from the supply container affixed to the syringe device and into the interior of the pouch-like enclosure. The monobath solution surrounds the exposed X-ray film.

After removing the injection needle by withdrawing it from the pouch-like enclosure and assuring the seal at the injection point as aforementioned, the pouch-like enclosure is massaged for about 15 seconds to thoroughly develop and fix the exposed X-ray film, the pouch-like enclosure is opened as aforementioned to remove the developed and fixed X-ray negative.

It is, therefore, an object of this invention to provide a rapid X-ray developing system.

It is also an object of this invention to provide a rapid X-ray developing system that does not leak the developing and fixing solution.

It is another object of this invention to provide a rapid X-ray developing system that has guide means for an injection means for a developing and fixing solution.

It is still another object of this invention to provide a rapid X-ray developing system that has a seal means to seal an opening where an injection has been made.

It is yet another object of this invention to provide a rapid X-ray developing system that provides a reinforcing means for preventing punctures or damages by a solution injection means.

Further objects and advantages of the invention will become more apparent in light of the following description of the preferred embodiments.

DESCRIPTION OF THE PREFERRED EMBODIMENTS

Figures 1, 2, 3:
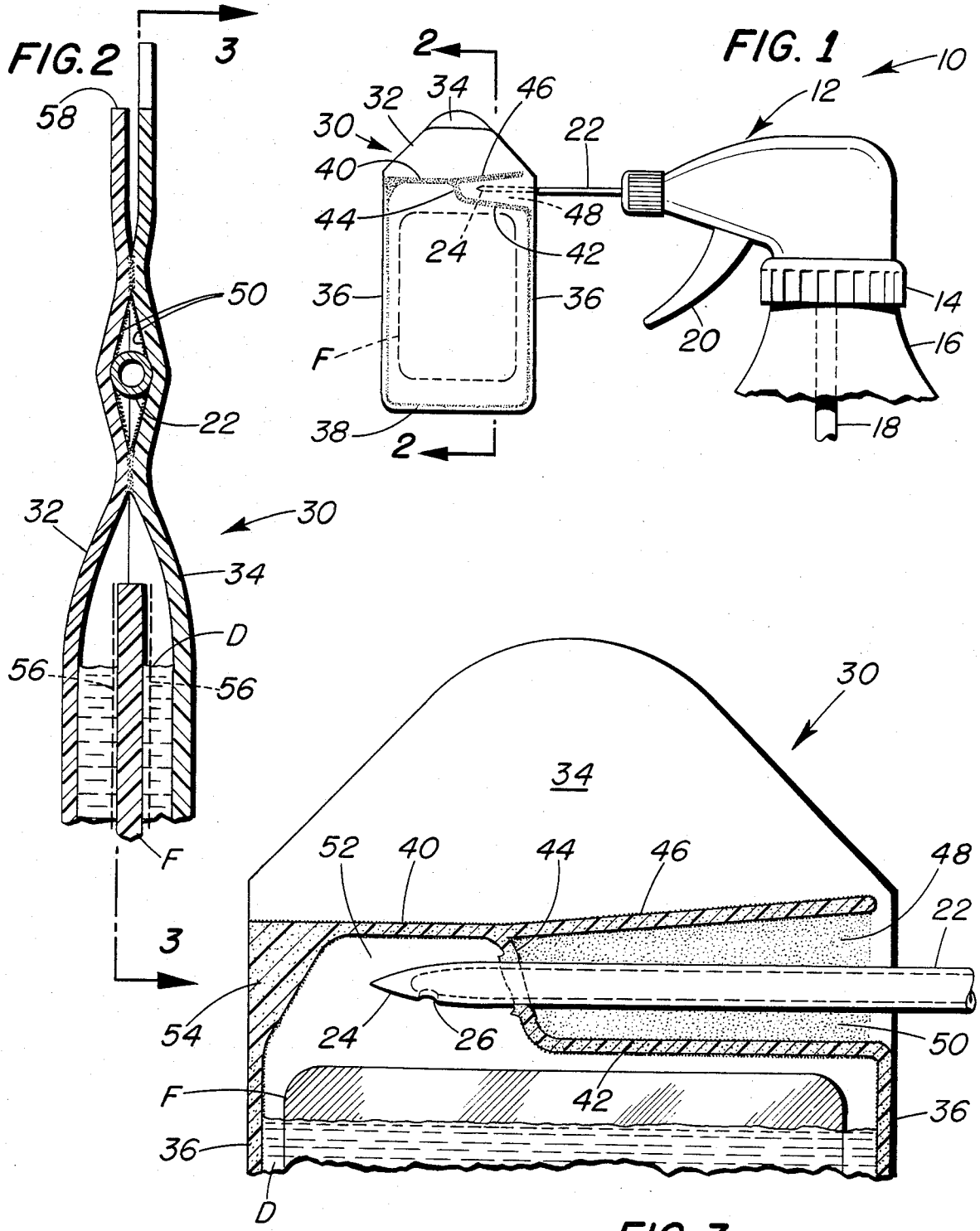
FIG. 1 is a partial generalized view of a rapid X-ray developing system.
FIG. 2 is an enlarged partial cross sectional view of FIG. 1 on line 2—2.
FIG. 3 is an enlarged partial cross sectional view of FIG. 2 on line 3—3, showing a penetrating injection needle into a component of a rapid X-ray developing system.

Referring now to the drawings, and particularly to FIG. 1, an improved rapid X-ray developing system is shown at 10.

The improved rapid X-ray developing system 10 consists of a film package component 30, a manually operated calibrated pump device 12, an injection needle 22 suitably affixed to the pump device 12, and a container 16 for a supply of a monobath solution "D".

The film component 30 will be described hereinafter later. The manually operated pump device 12 is calibrated to discharge specific amounts of liquid material when activated, in this case the monobath solution "D", a supply of which is carried in the container 16, shown in partial view in FIG. 2. The pump device 12 is fitted and threadably affixed to the container 16 by means of a screw cap 14 of the pump device 12. The injection needle 22 is hollow and is suitably affixed to the nozzle portion of the pump device 12, such as by a threadable coupling means at the end of the injection needle 22.

The pump device 12 is manually operated by activating the trigger mechanism 20 so as to syphon the monobath solution "D" from the supply carried in the container 16. The syphoning draws the monobath solution "D" up the syphon tube 18 of the pump device 12 and discharges it through the nozzle of the pump device 12 and into and out through the hollow injection needle 22. The hollow injection needle 22 has a pointed end 24 for puncturing, as described hereinafter, and a discharge opening 26 near the pointed end 24, said discharge opening 26 communicating said hollow interior of said injection needle 22 with the exterior thereof. The monobath solution "D" is discharged through the discharge opening 26 when the pump device 12 is activated.

It is to be understood that the syringe-type pump device 12 may be a mechanically operated pump means, such as by hydraulic means or by electric power, with a suitable container means for a supply of monobath solution "D", and a suitable means for connecting and affixing the injection needle 22 thereto, such as by a direct connection or by a tube means. Such variations are within the scope and intent of this invention.

The monobath solution "D" is a combined solution of developer and fixer solutions. This monobath solution "D" is carried in the container 16 until the X-ray film "F" is exposed and then the monobath solution "D" is injected into the film package component 30, as mentioned hereinbefore and as described hereinafter, in order to develop and fix the exposed X-ray film "F" to produce a permanent negative.

Turning now to FIGS. 2 and 3, with some reference to FIG. 1, the film package component 30 is seen in FIG. 1 as part of the overall improved rapid X-ray development system. FIGS. 2 and 3 provide enlarged cross sectional views of the film component package 30 with views of the injection needle 22 shown in the penetrating position for introducing the monobath solution "D" to surround and process the exposed X-ray film into a permanent negative. FIG. 2 is an enlarged partial longitudinal cross sectional view of FIG. 1 on line 2—2. FIG. 3 is an enlarged partial transverse cross sectional view of FIG. 2 on line 3—3.

The film package component 30 consists of a front wall member 32 suitably affixed to a back wall member 34. The suitable affixation is by water-tight or liquid-tight seams in a distinctive pattern as described hereinafter. The water-tight or liquid-tight seams in the distinctive pattern may be formed in any appropriate manner, consistent with the materials used for the front and back wall members 32 and 34 respectively, such as by heat sealing or friction welding when the front and back wall members 32 and 34, respectively, are of plastics-like materials where such seaming methods may be used. Any other seaming means, such as the use of adhesives and other similar methods, are within the scope and intent of this invention.

The basic seams, as described hereinafter, form a water-tight and liquid-tight enclosure for the unexposed film "F" as shown in FIGS. 1, 2, and 3. The distinctive seam pattern is described hereinafter. All of the seams in the distinctive seam pattern are sealing seams.

The distinctive seam pattern is seen best in FIG. 1 for the general layout of the pattern and specific details of the pattern are seen best in FIG. 3. The distinctive seam pattern consists of side seams 36 on the left and right sides of the film package component 30, bottom seam 38, and a combination of several seams at the top described hereinafter.

At the top of the film package component 30 a first top or upper seam 40 at the left side, a second top or upper seam 42 at the right side, and a connecting seam 44 connecting the end of the first top or upper seam 40 to the end of the second top or upper seam 42, forms the complete top or upper seam. The combination of the topmost seams so far described (first and second upper seams 40 and 42, respectively, and connecting seam 44), together with the two side seams 36, and the bottom seam 38 each of which is connected to the next succeeding seam in the periphery at the corners, thereby forms a pouch-like enclosure around the unexposed X-ray film "F". The pouch-like enclosure around the unexposed X-ray film "F" is water-tight or liquid-tight.

In addition a third top or upper seam 46 starts at the junction of the top or upper seam 40 and the uppermost end of the connecting seam 44, and extends generally horizontally to the right. The combination of the third top or upper seam 46, connecting seam 44, and the second top or upper seam 42 leaves an opening or entrance at the right side of the film package component 30 which forms a pocket 48. The pocket 48 also serves as a visible guide means for guiding the injection needle 22 when it is inserted as described later hereinafter.

The pocket 48 is filled with a self-sealing type sealer adhesive 50, shown by stippling in FIG. 3. The self-sealing type sealer 50 may be applied as a coating to the side walls of the pocket 48, actually the side walls of the pocket 48 are a portion of front wall member 32 and a portion of rear wall member 34, which can be seen in FIG. 2; in such an application of the self-sealing type sealer 50 to the side walls of pocket 48, the edges of the seams 42, 44, and 46 inside the pocket 48, are also coated. An alternative is to fill the pocket 48 with a self-sealing type sealer 50 to a thickness from the front wall member 32 to the rear wall member 34. The first method of coating the side walls of the pocket 48 is illustrated in the drawings and can be seen best in FIG. 2.

The unexposed X-ray film "F" encased in the pouch-like enclosure formed by the distinctive seam pattern, as described hereinbefore, may also have gauze-like or paper-like inserts 56 on each side of the unexposed X-ray film "F" in order to assist in thoroughly wetting and washing an exposed X-ray film "F" when monobath solution "D" is injected into the pouch-like enclosure for processing the exposed X-ray film "F".

It is to be understood that it is also within the scope and intent of this invention to omit the gauze-like or paper-like inserts 56.

In forming the seams as described hereinbefore, a reinforced enlarged seam portion 54 is constructed and formed at the junction of the left side seam 36 and the first top or upper seam 40. This enlarged reinforced seam portion 54 is to provide a protection against puncture or damage of the left side seam 36 by the injection needle 22 if the injection needle 22 is inserted too far.

As formed in the aforegoing description the pouch-like enclosure of the unexposed film "F", an open space or area 52 is formed in the top of the pouch-like enclosure between the left side seam 36, the enlarged reinforced portion 54, the first top or upper seam 40, and the connecting seam 44. This open space or area 52 is made specifically wide between the reinforced seam portion 54 and the connecting seam 44 to assist in gaging the needle point 24 position to prevent punctures at the side seam 36 and above.

When it is time to inject monobath solution "D" into the pouch-like enclosure to process an exposed X-ray film "F", the injection needle 22 is first carefully inserted into the pocket 48, using the pocket configuration as a guide to keep the injection needle 22 substantially horizontal. The injection needle is then pressed forward so that the pointed end 24 punctures the connecting seam 44 so that the injection needle 22 extends into the open space or area 52, but not so far as to have the injection needle 22 imbed or puncture into the enlarged seam portion 54. The rapid X-ray developing system 10 is now ready for the final steps in the rapid X-ray developing process.

The pump device 12 is operated, as described hereinbefore, and a quantity of monobath solution "D" is syphoned from the supply in the container 16 and injected through the injection needle 22, out through the discharge opening 26 of the injection needle 22 into the open space or area 52 and down into the pouch-like enclosure around the exposed film "F". When the calibrated amount of monobath solution "D" has been injected into pouch-like enclosure, the injection needle is withdrawn carefully and at the same time carefully squeezing the side walls of the pocket 48 together to self-seal the pocket 48 opening by means of the self-sealing sealer adhesive 50, thus cutting off any possibility of leakage of monobath solution "D" from the pouch-like enclosure of the exposed X-ray film "F".

The film package component 30 is then carefully massaged for about 15 seconds so that the monobath solution "D" thoroughly wets and washes the surfaces of the exposed X-ray film "F" and processes it, both developing and fixing by the monobath solution "D".

When ready, the front wall member 32 is separated from the rear wall member 34 by pulling them apart, that is, breaking the distinctive seam pattern in order to separate the front and back wall members 32 and 34, respectively. The front wall member 32 is shorter in length 58 than the rear wall member 34 in order to facilitate grasping the two members for making the separation. Once separated, the processed X-ray film is easily removed.

As can be readily understood from the foregoing description of the invention, the present structure can be configured in different modes to provide the ability for performing rapid X-ray film development.

Accordingly, modifications and variations to which the invention is susceptible may be practiced without departing from the scope and intent of the appended claims.

What is claimed is:

1. A rapid X-ray developing system, comprising:

a film package component, said film package component having a pouch-like enclosure and an adjacent separate pocket therewithin;

a seal means, said seal means being suitably affixed to the inside of said separate pocket;

an unexposed X-ray film, said unexposed X-ray film being enclosed within said pouch-like enclosure;

an injection means component, said injection means component being separate from said film package component; and a combined developing and fixing solution, said combined developing and fixing solution being contained within said injection means component, said combined developing and fixing solution being inserted into said pouch-like enclosure through said injection means component being inserted into said separate pocket at a selected time when said unexposed X-ray film has been exposed and is ready for processing, said injection means component being withdrawn thereafter.

2. A rapid X-ray developing system as recited in claim 1, wherein said film package component has a first wall member and a second wall member, said first wall member being suitably affixed to said second wall member, said affixation of said first wall member to said second wall member being by means of a distinctive pattern of seams, said distinctive pattern of seams thereby forming said pouch-like enclosure and said adjacent separate pocket within said film package component.

3. A rapid X-ray developing system as recited in claim 2, wherein said first wall member is shorter in longitudinal length than the longitudinal length of said second wall member, thereby providing a means of facilitating the easy separation of said first wall member from said second wall member.

4. A rapid X-ray developing system as recited in claim 2, wherein said distinctive pattern of seams consists of first and second side seams, a bottom seam, a first upper seam, a second upper seam, a connecting seam, and a third upper seam, said first and second side seams being substantially vertical at the sides of said film package component, said bottom seam being substantially horizontal at the bottom of said film package component, the separate ends of said bottom seam meeting and being connected to the lower-most ends of said first and second side seams, respectively, said first upper seam being substantially horizontal and having one end thereof meeting and being connected to the upper-most end of said first side seam, said second upper seam being substantially horizontal and being spaced downwardly at a lower elevation than said first upper seam, said second upper seam having one end thereof meeting and being connected to the uppermost end of said second side seam, said first and second upper seams being of a lesser horizontal length than said bottom seam, the distal ends of said first and second upper seams meeting and being connected to the separate ends of said connecting seam, the said connections of said first and second side seams, said bottom seam, said first and second upper seams, and said connecting seam forming a continuous seam in said distinctive pattern and thereby forming said pouch-like enclosure within said film package component between said first and second wall members, said third upper seam member having one end thereof meeting and being connected to the juncture of said first upper seam and said connecting seam, said third upper seam member being substantially horizontal in direction so that the distal end thereof is above and spaced from the juncture of said second side seam and said second upper seam, said second upper seam, said connecting seam, and said third upper seam thereby forming said separate pocket adjacent to said pouch-like enclosure.

5. A rapid X-ray developing system as recited in claim 1 and additionally, a pair of gauze-like inserts, said pair of gauze-like inserts being placed next to the faces of said unexposed X-ray film, one gauze-like insert on each side of said unexposed X-ray film component enclosed within said pouch-like enclosure.

6. A rapid X-ray developing system as recited in claim 1, wherein said injection means component consists of a pump means, a container means, and an injection needle means, said container means being suitably threadably and removably affixed to said pump means, said injection needle means being suitably threadably and removably affixed to said pump means, said combined developing and fixing solution being stored in said container means as a supply of said combined developing and fixing solution.

7. A rapid X-ray developing system as recited in claim 6, wherein said pump means is a manually operated pump mechanism having a trigger operated syphon system, said syphon system having a syphon tube to extend into said container and thereby into said combined developing and fixing solution, said pump means having a screw cap type connection means for threadably and removably affixing said pump means to said container means, said pump means having a threaded nozzle portion for threadably and removably affixing said injection needle means thereto.

8. A rapid X-ray developing system as recited in claim 7, wherein said injection needle means is a hollow needle having a pointed leading end and a threaded coupling means at the opposite end, said threaded coupling means being configured for threadably and removably affixing said injection needle means to said threaded nozzle portion of said pump means, said hollow needle having a discharge aperture therein in close proximity to said pointed leading end, said discharge aperture communicating said hollow interior with the exterior thereof.

9. A rapid X-ray developing system as recited in claim 1, wherein said seal means is a self-sealing adhesive means, said seal means being suitably applied to the inside wall areas of said separate pocket, said seal means on opposite walls of said separate pocket adhering to each other under pressure and thereby sealing said pocket opening after withdrawal of said injection means component.

10. A rapid X-ray developing system, comprising:

a film package component, said film package component having a first wall member and a second wall member, said first wall member being suitably affixed to said second wall member, said affixation of first wall member to said second wall member being by means of a distinctive pattern of seams, said distinctive pattern of seams thereby forming a liquid-tight pouch-like enclosure and an adjacent separate pocket;

an unexposed X-ray film, said unexposed X-ray film being enclosed within said liquid-tight pouch-like enclosure;

an injection means component, said injection means component being separate from said film package component, said injection means component having a pump means, an injection needle means, and a container means, said injection needle means and said container means being suitably and removably threadably affixed to said pump means;

a supply of a combined developing and fixing solution, said supply of combined developing and fixing solution being held in said container means, said injection needle means being inserted into said film package component through said separate pocket at a selected time after said unexposed X-ray film has been exposed and thereby is ready for processing, said injection needle means being withdrawn thereafter; and a seal means, said seal means being suitably affixed to the inside wall surfaces of said separate pocket, said seal means effectively sealing said inside wall surfaces together.

* * * * *